US005349364A

United States Patent [19]

Bryanos et al.

[11] Patent Number: 5,349,364

[45] Date of Patent: Sep. 20, 1994

[54] ELECTROMAGNETIC POWER DISTRIBUTION SYSTEM COMPRISING DISTINCT TYPE COUPLERS

[75] Inventors: James Bryanos, Nahant; Timothy Soule, Newbury; Michael Harris, Melrose, all of Mass.

[73] Assignee: Acvo Corporation, Providence, R.I.

[21] Appl. No.: 904,597

[22] Filed: Jun. 26, 1992

[51] Int. Cl.[5] ..... H01P 5/12; H01Q 21/06

[52] U.S. Cl. ..... 343/853; 343/770; 343/700 MS; 333/116; 333/117; 333/128; 333/136

[58] Field of Search ..... 333/109, 116, 117, 128, 333/136; 343/700 MS, 767, 770, 853; 342/371–373

[56] References Cited

U.S. PATENT DOCUMENTS

| | | | |
|---|---|---|---|
| H880 | 1/1991 | Patin | 333/116 |
| 2,414,431 | 1/1947 | Alford et al. | 342/414 |
| 2,789,271 | 4/1957 | Budenbom | 333/120 |
| 3,071,769 | 1/1963 | Randall et al. | 333/117 X |
| 3,295,134 | 12/1966 | Lowe | 333/109 X |
| 3,307,189 | 2/1967 | Meade | 342/378 |
| 3,375,524 | 3/1968 | Kunemund et al. | 343/799 |
| 3,495,263 | 2/1970 | Amitay et al. | 343/777 |
| 3,668,567 | 6/1972 | Rosen | 333/21 A |
| 3,701,158 | 10/1972 | Johnson | 343/853 X |
| 4,101,892 | 7/1978 | Alford | 343/853 X |
| 4,231,040 | 10/1980 | Walker | 342/373 |
| 4,241,352 | 12/1980 | Alspaugh et al. | 343/700 MS |
| 4,316,159 | 2/1982 | Ho | 333/104 |
| 4,423,392 | 12/1983 | Wolfson | 333/116 |
| 4,427,936 | 1/1984 | Riblet et al. | 333/128 X |
| 4,471,361 | 9/1984 | Profera et al. | 343/853 |
| 4,584,582 | 4/1986 | Munger | 343/373 |
| 4,639,694 | 1/1987 | Seino et al. | 333/128 |
| 4,652,880 | 3/1987 | Moeller et al. | 342/373 |
| 4,689,627 | 8/1987 | Lee et al. | 342/373 |
| 4,691,177 | 9/1987 | Wong et al. | 333/113 |
| 4,710,776 | 12/1987 | Roederer et al. | 343/778 |
| 4,764,771 | 8/1988 | Sterns | 342/373 |
| 4,827,270 | 5/1989 | Udagawa et al. | 343/853 |
| 4,965,588 | 10/1990 | Lenormand et al. | 342/372 |
| 5,001,492 | 3/1992 | Shapiro et al. | 343/700 MS |
| 5,189,433 | 2/1993 | Stern et al. | 343/853 X |

FOREIGN PATENT DOCUMENTS

| | | | |
|---|---|---|---|
| 3503445 | 10/1985 | Fed. Rep. of Germany | 333/117 |

*Primary Examiner*—Benny T. Lee
*Attorney, Agent, or Firm*—Perman & Green

[57] ABSTRACT

A stripline or microstrip feed system distributes electromagnetic power among a set of utilization devices such as the radiators of an array antenna. In the feed system, elongated assemblies of microwave couplers are arranged side by side to provide for a two-dimensional array of couplers corresponding to a two-dimensional array of radiators in rows and columns of an array antenna, and allowing beam steering in a direction perpendicular to the rows. In each assembly of couplers, different forms of couplers are employed to provide both an amplitude taper and a phase taper to the radiations of the respective radiators in each row of radiators. The couplers include the Wilkinson coupler, the hybrid coupler, and the backward wave coupler which serve as power dividers during transmission. There is a feeding of the output signal of one coupler, via a first coupler output terminal to a next coupler in a series of couplers, while the remainder of the power is fed via a second coupler output terminal to a radiator of the antenna. In each coupler assembly there is a main conductor which interconnects a plurality of the couplers to provide a configuration of coupler assembly having a desired narrow width, less than approximately one free-space wavelength.

12 Claims, 3 Drawing Sheets

10
30
SIGNAL GENERATOR
34
POWER SOURCE
32
BEAM CONTROLLER
50
POWER DIVIDER
36
CONDUCTOR LAYER, 14
38A
38B
38C
38D
38
SY
SX
26
44
22
46
46A
60A
60B
60C
48
62
42
40

ELECTROMAGNETIC POWER DISTRIBUTION SYSTEM COMPRISING DISTINCT TYPE COUPLERS

BACKGROUND OF THE INVENTION

This invention relates to the distribution, or feeding, of electromagnetic power from a source of the power to an array of power utilization devices, such as radiators of an array antenna and, more particularly, to the feeding of power by a planar system of rows and columns of microwave couplers at a fixed frequency or frequency band allowing for a steering of a beam of radiation from the array antenna in one plane, perpendicular to a plane of the radiators of the antenna, while allowing for differential phase shift and amplitude to signals applied to adjacent radiators by the feed assembly.

A two-dimensional array antenna may be described in terms of an XYZ coordinate axes system having an X axis, a Y axis and a Z axis which are orthogonal to each other, wherein the radiators are arranged in rows along the Y direction and in columns along the X direction. It is common practice to construct the antenna with control circuitry for controlling the amplitude and the phase of the signal radiated by each radiator, the control circuitry including, by way of example, an electronically controlled phase shifter and an electronically controlled attenuator or amplifier. The control circuitry extends in the the Z direction, perpendicular to the plane of the radiators and the radiating aperture of the antenna. To insure a well-formed beam without excessive grating lobes, the spacing of the radiators and the corresponding spacing of the control circuits is less than approximately one free-space wavelength of the electromagnetic radiation radiated by the radiators, for example, less than or equal to 0.9 wavelengths for a beam of radiation which remains stationary relative to the antenna. However, for an antenna which is to provide a scanning of a beam relative to the antenna, the spacing normally is less than one wavelength but greater than or equal to one-half wavelength along a coordinate axis for which the beam is to be scanned.

A problem arises in that the foregoing control circuitry may have excessive weight and physical size for some antenna applications, particularly for antennas which provide a scanning capacity along one or two coordinate axes. For array antennas providing only a stationary beam or a beam which is to be steered in only one of the coordinate directions, X or Y, a planar configuration of a radiator feed system is preferred to reduce both size and weight of the antenna. Planar feed systems have been built, such as a set of parallel waveguides disposed side by side, and having a set of radiating slots disposed along walls of the waveguides to serve as radiators of the antenna. Steering of a beam can be accomplished by varying the frequency of the radiation, this resulting in a sweeping of the beam in a direction parallel to the waveguides. Such a feed system presents a specific relationship between frequency and beam direction, and cannot be used in the general situation in which beam direction must be independent of frequency. A further disadvantage of such a feed system is the lack of a capacity to adjust individually the values of phase shift and amplitude of signals between adjacent ones of the radiators. Such a capability of adjustment of phase and amplitude is important for developing a desired beam profile. Stripline or microstrip feed structures have also been found useful in the construction of planar feed systems because the physical size of a power divider in stripline or microstrip is smaller than the aforementioned one-half free-space wavelength. However, existing stripline and microstrip feed structures do not permit the desired beam formation, scanning, and radiator layout in combination with the capacity for adjustment of phase and amplitude to signals of adjacent radiators.

SUMMARY OF THE INVENTION

The aforementioned problem is overcome and other advantages are provided by a stripline or microstrip feed system for distributing electromagnetic power among a set of utilization devices such as the radiators of an array antenna. In accordance with the invention, the feed system comprises assemblies of microwave couplers arranged in rows with the assemblies arranged side by side to provide for a two-dimensional array of couplers corresponding to a two-dimensional array of radiators of an array antenna. In the following description of the invention, reference is made to the transmission of electromagnetic signals for convenience in describing the invention; however, it is to be understood that the invention applies equally well to the reception of electromagnetic signals, and that the apparatus of the invention is operative both for transmission and reception of electromagnetic power.

The advantages of the invention are understood best with reference to use of the invention for feeding a two-dimensional array antenna having radiators arranged in rows and columns with beam steering being provided in only one direction, namely, in the direction of the columns perpendicular to the rows. In each assembly of couplers, different forms of couplers are employed to provide both an amplitude taper and a phase taper to the radiations of the respective radiators in each row of radiators. The couplers differ in their phase-shift characteristics and in their power coupling ratios. As an example of well-known couplers which may be employed in the practice of the invention, a preferred embodiment of the invention employs the Wilkinson coupler, the hybrid coupler, and the backward wave coupler. As an example of further couplers, the Lange and the rat-race couplers, may be employed. During transmission of electromagnetic signals from the antenna, each coupler is employed as a power divider. During reception of electromagnetic signals by the antenna, each coupler is employed as a power combiner. The couplers have characteristics which may be demonstrated for the transmission of power. The Wilkinson coupler divides input power among two output terminals with substantially equal phase while providing for power division in a ratio range of 2–4 dB (decibels). The hybrid coupler divides input power among two output terminals with substantially ninety-degree phase difference while providing for power division in a ratio range of 2–10 dB. The backward wave coupler divides input power among two output terminals with substantially ninety-degree phase difference while providing for power division in a ratio range of 10–30 dB.

The construction of an assembly of couplers is accomplished by feeding the output signal of one coupler, via a first of the output terminals, to the next coupler in a series of couplers, while the remainder of the power is fed via the second of the output terminals to a radiator of the antenna. In this manner, each radiator of a row of radiators is fed by a respective one of the couplers of an elongated row-shaped assembly of couplers. For example, within a single coupler assembly, a series of two Wilkinson couplers may be employed to provide equal amplitude and phasing of signals to two radiators. A second series of two Wilkinson couplers may be employed to provide equal amplitude and phasing of signals to two other radiators of the same row of radiators. The two series of couplers are fed via serially connected hybrid couplers to provide for a total of four radiators receiving equal power from the Wilkinson couplers. One or more of the hybrid couplers may be employed to feed further radiators of the row.

In a preferred embodiment of the invention, the feed assembly is employed with an array of slot radiators fed by probes extending transversely of the slot radiators. An additional 180 degrees of phase shift introduced by the hybrid couplers is essentially canceled by reversing the directions of feeding transmission line sections which couple to radiators of the antenna. Thus, the couplers of a coupler assembly can be oriented along a straight line. This arrangement of the couplers of a coupler assembly allows positioning of the coupler assemblies side by side with a spacing that matches the normal spacing of antenna radiators, namely, less than one free space wavelength but greater than or equal to approximately one half of the free-space wavelength, to permit beam steering in a direction perpendicular to the rows of couplers. However, the principles of the invention allow for a spacing, if desired, of even less than a half of the free-space wavelength. The beam steering is accomplished by feeding each coupler assembly by a distribution network in which each assembly receives the requisite phase for steering the beam.

It is noted that, in the stripline or microstrip form of feed structure for an array antenna, the physical size of a coupler of the feed structure can be made smaller than one half of the free-space wavelength to be transmitted or received by radiators of the array antenna. This permits the couplers to be positioned sufficiently close together for the practice of the invention. However, in order to take advantage of the small size of the couplers, in accordance with a feature of the invention, the couplers for feeding a row of radiators are arranged side by side in a row of the feed structure so as to provide a total width of a row of couplers which does not exceed the spacing, of the rows of the antenna radiators. This feature of the invention is accomplished by use of a main conductor, in stripline or microstrip form, which interconnects all couplers in a series of couplers in a row of the feed structure. The interconnection of the main conductor is attained by connecting one output terminal of a coupler to a radiator, and by connecting the other output terminal of the coupler to the next coupler in the series of couplers. In the case of the last coupler in the series of couplers, both output terminals may be connected to radiators. Thus, the array of the couplers in a row of the feed structure is a one dimensional array as compared with a prior-art corporate form of feed structure having a two-dimensional array. In the corporate feed structure, the two output terminals of one coupler feed two couplers each of which, in turn, feed two more couplers. Thereby, in the feed structure of the invention, each row of couplers has a width commensurate with the width of a row of radiators of the antenna which is fed by the feed structure.

Yet another feature of the invention is attained by use of the main conductor in concert with the small size of each coupler. In stripline and in microstrip conductors, there is an accumulation of phase shift to a signal propagating along the conductor. In a row of couplers, advantage is taken of the phase shift accumulation by displacing a coupler slightly along the main conductor, in one direction or in the opposite direction, so as to increase or decrease the phase shift presented to the signal applied to a radiator. This accomplishes a more precise configuration of the antenna radiation pattern.

BRIEF DESCRIPTION OF THE DRAWING

The aforementioned aspects and other features of the invention are explained in the following description, taken in connection with the accompanying drawing wherein.

DETAILED DESCRIPTION

Figure 1:
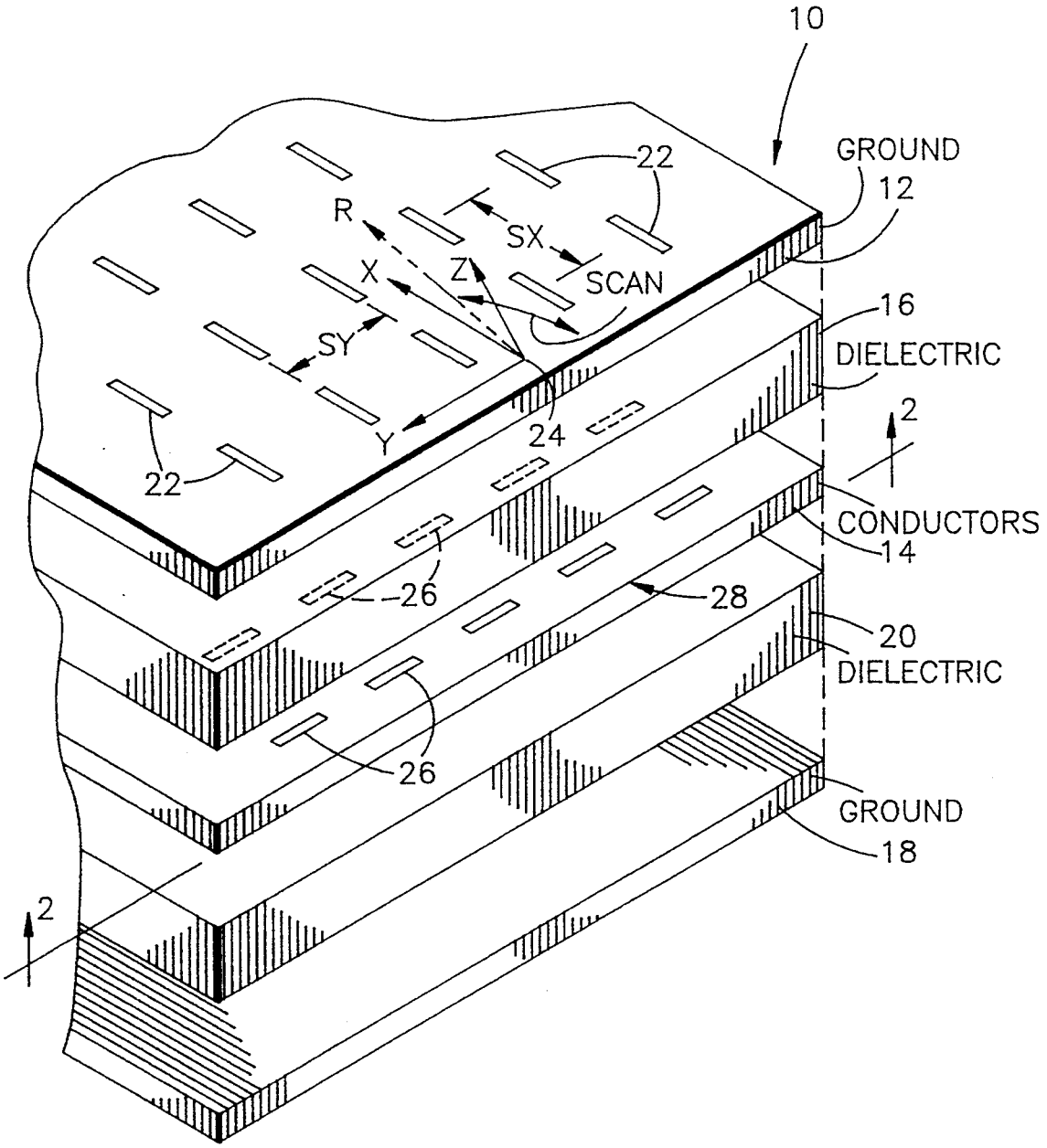
FIG. 1 shows a stylized fragmentary exploded view of a stripline array antenna incorporating a feed system constructed in accordance with the invention.

In FIG. 1, an array antenna 10 is constructed in stripline form and includes a top electrically conductive layer 12, a middle layer 14 of electrically conductive elements, an upper dielectric layer 16 disposed between and contiguous to the top layer 12 and the middle layer 14, a bottom electrically conductive layer 18, and a lower dielectric layer 20 disposed between and contiguous to the middle layer 14 and the bottom layer 18. The top and the bottom layers 12 and 18 serve as ground planes for electromagnetic signals propagating along conductors of the middle layer 14 and having electric fields extending through the dielectric layers 16 and 20 to the ground planes of the layers 12 and 18. Radiating elements, or radiators, are constructed, by way of example, as parallel slots 22 disposed in rows and columns of a two-dimensional array extending in an XY plane of an XYZ orthogonal coordinate system 24. The rows are parallel to the X axis, and the columns are parallel to the Y axis. Electromagnetic power radiated from the antenna 10 propagates as a beam generally in the Z direction, as indicated by a radius vector R, and may be scanned, as indicated by scan in FIG. 1, in a plane perpendicular to the rows, namely, the XZ plane. The slots 22 are positioned with a spacing Sx (shown in FIGS. 1 and 2) of one half of the free-space wavelength in the X direction to enable the foregoing scanning while maintaining a beam profile which is substantially free of grating lobes. In the practice of the preferred embodiment of the invention, the spacing Sy (shown in FIGS. 1 and 2) of the slots 22 along the perpendicular direction, namely, along the Y axis, is also one-half of the free-space wavelength.

The electrically conductive layers 12, 14, and 18 are formed of metal such as copper or aluminum, and the dielectric layers 16 and 20 are formed of a dielectric, electrically insulating material such as alumina. Conductors of the middle layer 14, to be described in further detail in FIG. 2, may be formed by photolithography.

These conductors include transmission line sections 26 which, as shown in FIG. 1, are arranged in alignment with the slots 22, and have their longitudinal dimensions oriented perpendicular to the direction of the slots 22. As will be described hereinafter with reference to FIGS. 2–6, the transmission line sections 26 constitute part of a feed system 28 and serve to couple electromagnetic signals to the slots 22, thereby to activate the slots 22 to emit radiation for formation of the aforementioned beam. Each of the transmission line sections 26 extends beyond a central portion of its corresponding slot 22 by a distance equal to one quarter of a wavelength of an electromagnetic signal propagating within the stripline for matching impedance of each transmission line section 26 to the impedance of its slot 22.

Figure 2:
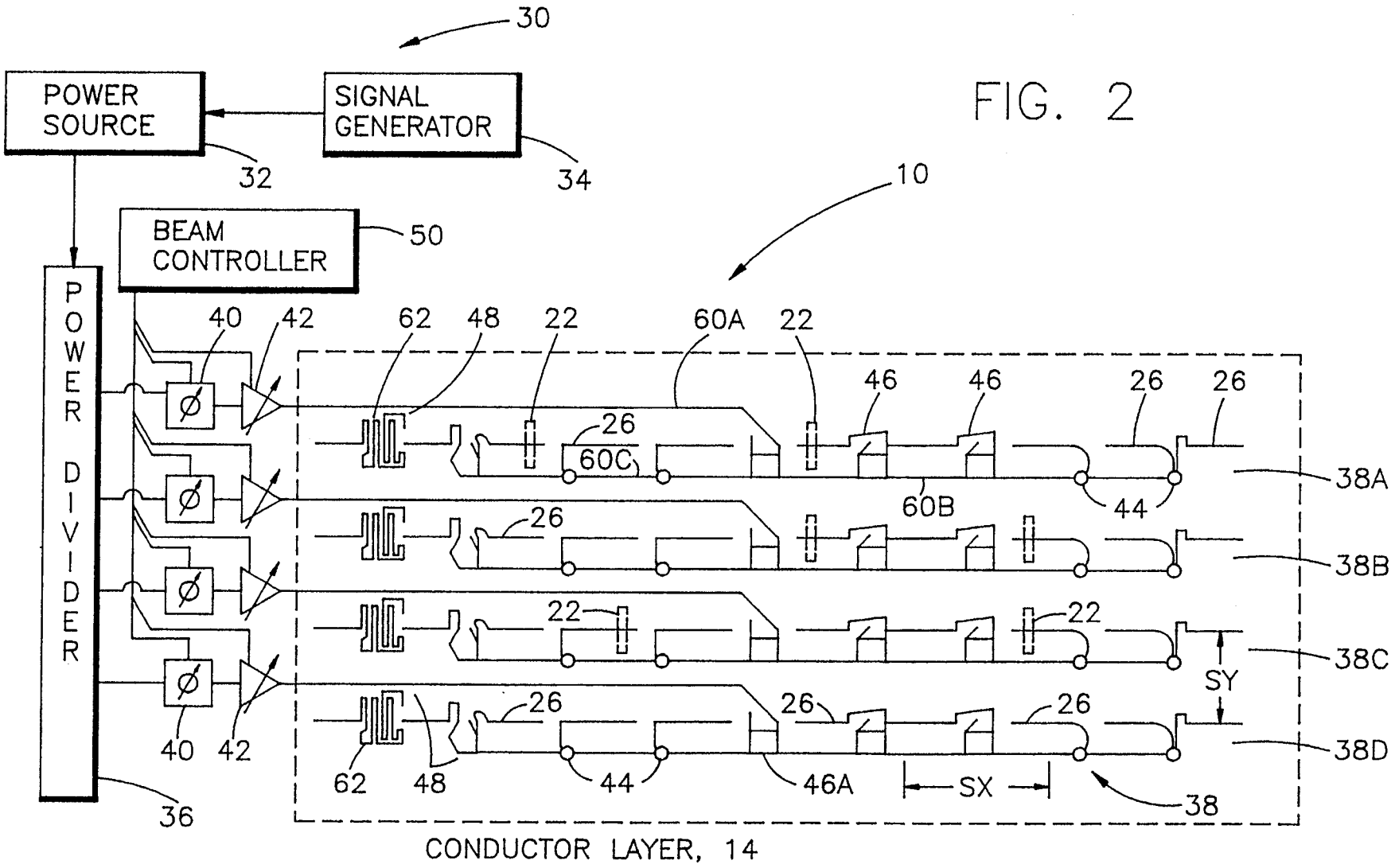
FIG. 2 shows a cross-sectional view of the antenna taken along the line 2—2 in FIG. 1, FIG. 2 showing diagrammatically also external circuitry for energizing radiators of the antenna to accomplish a steering of a beam of the antenna in one plane.

FIG. 2 provides a sectional view of the antenna 10 taken along a surface of the middle conductor layer 14 so as to show details in the arrangement and the configurations of the conductive elements including stripline couplers which serve as power dividers for distribution of power among the slots 22. Also included within FIG. 2 is circuitry 30, shown diagrammatically, for energizing the stripline circuitry. The circuitry 30 comprises a source 32 of microwave power, such as a microwave oscillator (not shown) which is driven by a signal generator 34. By way of example, the generator 34 may include a modulator (not shown) for applying a phase and/or an amplitude modulation to a carrier signal outputted by the source 32. Power outputted by the source 32 is divided by a divider 36 among a plurality of parallel channels 38 of which four channels 38A, 38B, 38C, 38D are shown by way of example. For each of the channels 38, there is provided a variable phase shifter 40 and an amplifier 42 through which a respective output signal of the power divider 36 is applied to the corresponding channel 38.

In accordance with the invention, each channel 38 also comprises an assembly of interconnected stripline couplers including Wilkinson couplers 44, hybrid couplers 46, and backward wave couplers 48. In each of the channels 38, input power is coupled from the amplifier 42 to a central hybrid coupler 46A for distribution to both the left and the right sides of the stripline portion of the channel 38. The stripline portion of each channel 38 is enclosed by a dashed line designating the middle conductor layer 14 of the antenna 10. The phase and the amplitude of each of the signals applied to the respective ones of the channels 38 is controlled by the corresponding phase shifter 40 and amplifier 42 under command of a beam controller 50 of the circuitry 30. A differential phase shift provided to the respective channels 38, under command of the beam controller 50, provides for a scanning of the beam, and the independent amplitude control for the respective channels 38 allows for a shaping of the beam profile.

For reception of signals by the middle conductor layer 14, each amplifier would be part of a transmit-receive circuit (not shown) including a preamplifier for amplification of received signals. The received signals of the respective channels 38 would be coupled via the phase shifters 40 and summed by the divider 36. The divider 36 and the phase shifters 40 are operative in reciprocal fashion so as to allow the stripline circuitry of the middle layer 14 to operate in either the transmit or the receive mode. Also, by way of alternative embodiments, it is noted that the stripline structure of the antenna 10 (FIG. 1) can be converted to a microstrip structure by deletion of the bottom ground layer 18 and the lower dielectric layer 20. The basic explanation of the invention, in terms of the arrangement and the configurations of the couplers of FIG. 2, is essentially the same for both the microstrip and the stripline embodiments of the invention.

Figure 3:
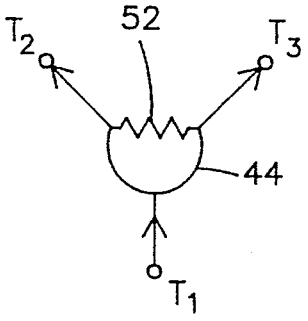
FIG. 3 shows diagrammatically a Wilkinson coupler.
Figure 4:
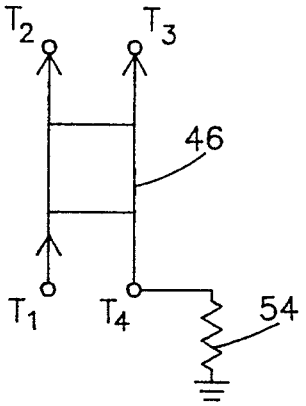
FIG. 4 shows diagrammatically a hybrid coupler.
Figure 5:
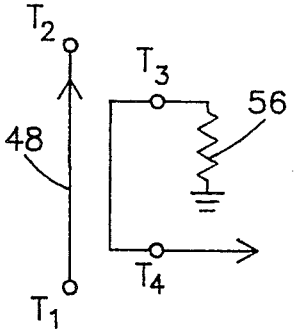
FIG. 5 shows diagrammatically a backward wave coupler.

FIGS. 3–6 show details in the construction and interconnection of the microwave couplers in both the stripline and the microstrip embodiments of the invention. In FIG. 3, the Wilkinson coupler 44 is a three-terminal device having one input terminal, T1 and two output terminals T2 and T3. The two output terminals are connected by a load resistor 52. In FIG. 4, the hybrid coupler 46 is a four terminal device having two input terminals T1 and T4, and two output terminals T2 and T3. One input terminal T1 receives the input signal, and the other input terminal is grounded by a load resistor 54. In FIG. 5, the backward wave coupler 48 is a four terminal device having two input terminals T1 and T3, and two output terminals T2 and T4. One input terminal T1 receives the input signal, and the other input terminal is grounded by a load resistor 56.

Figure 6:
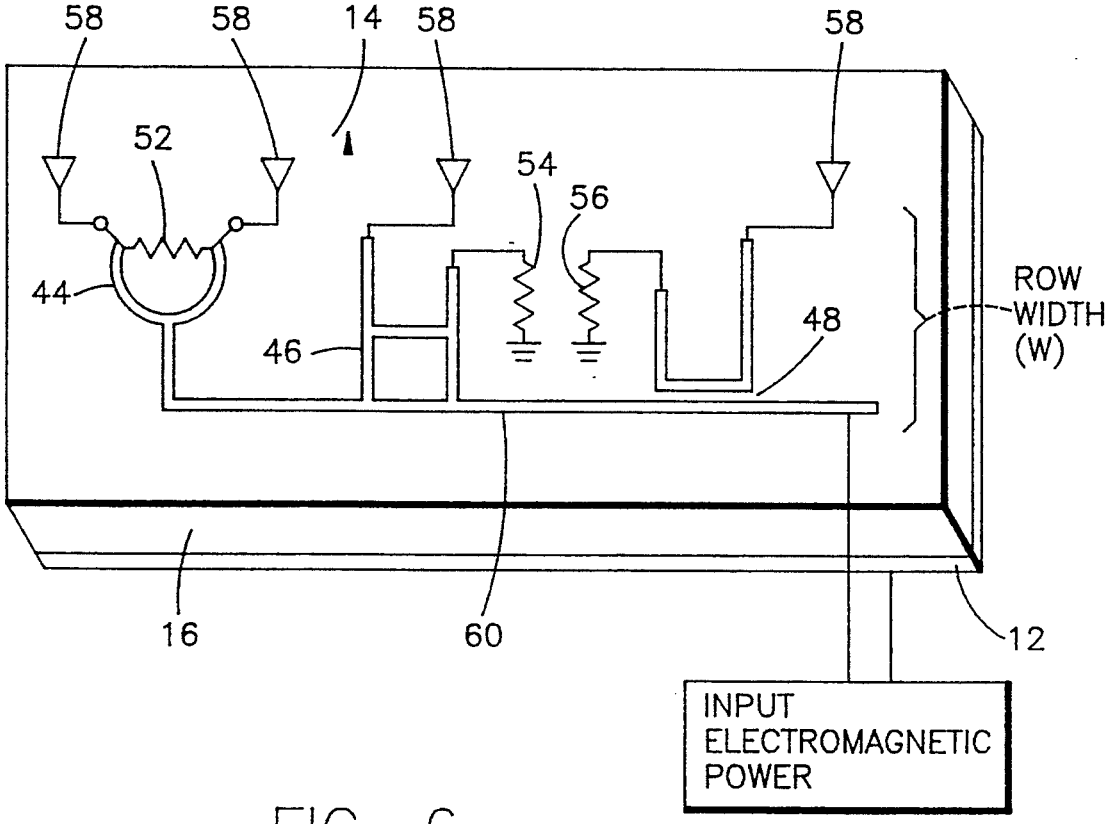
FIG. 6 shows diagrammatically a series of interconnected couplers.

FIG. 6 shows an example of an interconnection among the three forms of couplers. FIG. 6 shows only the top layer 12, the middle layer 14, and the upper dielectric layer 16, to simplify the drawing. Alternatively, FIG. 6 may be regarded as a microstrip embodiment of the invention. The two output terminals of the Wilkinson coupler 44 are connected each to some form of power utilization device such as an antenna radiator 58. Similarly, one output terminal of the hybrid coupler 46 and the backward wave coupler 48 are connected each to a radiator 58. The connections of the couplers 44, 46, and 48 with their respective load resistors 52, 54, and 56, respectively, are as shown above with reference to FIGS. 3, 4, and 5.

In accordance with a feature of the invention, all three couplers 44, 46 and 48 are interconnected by a single main conductor 60 extending in the row or Y direction, and adding no more than a negligible amount to the width W of the row. This maintains the narrow width of the assembly of couplers so as to permit the placement of the rows of the respective channels 38 within the required limitation of as small as one half of a free-space wavelength. Input electromagnetic power is connected to the right end of the main conductor 60 by application of the microwave signal between the main conductor 60 and the ground of the top layer 12, as well as the ground of the bottom layer 18 (not shown in FIG. 6). The electromagnetic power propagates toward the left with a portion of the power being drawn off by the backward wave coupler 48 for its radiator 58, a portion being drawn off by the hybrid coupler 46 for its radiator 58, and the remainder being received by the Wilkinson coupler 44 for both its radiators 58. In terms of coupling ratio, the backward wave coupler 48 might extract minus 20 dB of the inputs power for its radiator 58, the hybrid coupler 46, might extract 10 dB of the remainder for its radiator 58, and the balance might be divided evenly among the two radiators 58 of the Wilkinson coupler 44.

The feature of the main conductor 60 is attained by connecting only one output terminal of a coupler to a radiator 58, and by connecting the other output terminal to the next coupler, except for the last coupler in the series of couplers wherein both output terminals are connected to radiators 58. Thereby, at all locations within the coupler assembly of a channel 38 (FIG. 2), the coupler assembly has a width W equal essentially to the height of any one of the couplers 44, 46 and 48.

With respect to phase shift, each of the couplers has a minimum phase lag of 90 degrees between an input terminal and an output terminal. Thus a signal propagating along the main conductor 60 experiences a phase lag of 90 degrees in the passage through the backward wave coupler 48, another lag of 90 degrees during passage through the hybrid coupler 46, and a further lag of 90 degrees during passage through the Wilkinson coupler 44. Also, the signal experiences phase shift during propagation along the main conductor 60 between the couplers. With the aforementioned spacing between coupler of one-half of a free-space wavelength, the parameters of dielectric constant and thickness, as well as the widths of the conductors of the middle layer 14 are selected to provide an accumulated phase shift of 360 degrees from the input terminal of one coupler to the input terminal of the next coupler. Thus, the signal experiences a phase lag of 270 degrees between couplers. In addition, the backward wave coupler 48 introduces a further 90 degrees phase shift between its output terminal on the main conductor 60 and its output terminal connected to the radiator 58. Similarly, the hybrid coupler 48 introduces a further 90 degrees phase shift between its output terminal on the main conductor 60 and its output terminal connected to the radiator 58. Further phase adjustment can be attained by placing bends (not shown in FIG. 6) in the main conductor 60. Thereby, the invention allows for adjustment of both phase and amplitude of signals applied to the radiators 58 of FIG. 6.

The foregoing constructional features of the invention are found also in the stripline of FIG. 2. In each channel 38, there are three main conductors 60A, 60B and 60C, each being generally parallel to the X axis (FIG. 1). The main conductor 60A connects the amplifier 42 to the center of the coupler assembly, at the central hybrid coupler 46A. The main conductor 60B extends from the hybrid coupler 46A to the right side of the coupler assembly, and the main conductor 60C extends from the central hybrid coupler 46A to the left side of the coupler assembly. A small portion of the signal on the main conductor 60A, possibly minus 20 dB or minus 30 dB is extracted by the backward wave coupler 48, in each channel 38, and is applied via a delay line 62 to a transmission line section 26. Due to differences in phase shift accumulated in the right side of a channel 38 at the hybrid couplers 46, as compared to the Wilkinson couplers 44 at the corresponding left side positions of the channel 38, there is a need to introduce a compensating phase shift of 180 degrees. This is accomplished by feeding the transmission line sections 26 from the right end of the lines 26 on the right side of each channel 38, and by feeding the corresponding lines 26 from the left end on the left side of each channel 38. This opposed direction of feeding reverses the phases of the signals induced in the corresponding slots 22 (shown in FIG. 2) so as to attain substantial uniformity of radiation from the various slots 22. Additional phase shift adjustment can be obtained by addition of further length of stripline conductor between output terminal of a coupler and its associated transmission line section 62. The desired amplitude can be obtained by configuring each coupler to provide the desired coupling ratio. Thereby, the invention provides for a feed system wherein, in each channel 38, a desired phase and amplitude can be obtained by planar circuitry disposed parallel to a radiating aperture of the antenna 10, and within the constraints of one-half of a free-space wavelength in both the X and the Y coordinate directions of the radiating aperture.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A feed system for electromagnetic signal power, comprising:

a plurality of elongated coupler assemblies disposed side by side in a common plane in a first direction, each of said assemblies extending in a second direction perpendicular to said first direction, each of said assemblies comprising a plurality of couplers of electromagnetic power arranged in a row extending in said second direction;

wherein, in any one of said assemblies, said plurality of couplers comprises at least three couplers, each of said couplers has an input terminal for receiving an input electromagnetic power, each of said couplers has a first output terminal for outputting a first fraction of said input power and a second output terminal for outputting a second fraction of said input power, said second fraction being a power division ratio of the coupler;

in any one of said assemblies, the division ratio of any one of said couplers has a nominal value which differs from a nominal value of the division ratio of another of said couplers;

in each of said assemblies, each of said respective couplers has a respective phase-shift characteristic with introduction of a specific phase shift between said first output terminal and said second output terminal of the coupler, wherein a magnitude of the specific phase shift of any one of said couplers differs from a magnitude of the specific phase shift of another of said couplers;

in each of said assemblies, among said plurality of couplers in said assembly, the first output terminal of a first of said couplers is connected to the input terminal of a next second of said couplers in the row of couplers, the first output terminal of said second coupler is connected to the input terminal of a third of said coupler in the row of couplers, and the second output terminals of said first coupler and of said second coupler and of said third coupler output electromagnetic power to radiating elements of an antenna having an array of radiating elements upon a connection of respective ones of the radiating elements to the second output terminals in respective ones of said couplers in said row of couplers; and each of said assemblies of couplers comprises a main conductor interconnection the couplers of said row of couplers, the input terminal and the first output terminal of each of the couplers of said row of couplers comprising sections of said main conductor.

2. A system according to claim 1 wherein said plurality of elongated coupler assemblies are disposed side by side in said first direction with respective spacing therebetween being less than approximately one wavelength of said electromagnetic power, and in each of said assemblies, said couplers of electromagnetic power are arranged in said row with respective spacing these between being less than or approximately equal to a wavelength of said electromagnetic power.

3. A system according to claim 1 wherein each of said coupler assemblies has a stripline form including opposed conductive ground planes disposed on opposite sides of a conductive central plane and spaced apart from said central plane, said main conductor being disposed in said central plane.

4. A system according to claim 1 wherein said plurality of elongated coupler assemblies are disposed side by side in said first direction with respect spacing therebetween being less than approximately one wavelength of said electromagnetic power, and in each of said assemblies said couplers of electromagnetic power are arranged in said row with respect spacing therebetween being less than or approximately equal to a wavelength of said electromagnetic power;

said plurality of couplers in any one of said assemblies comprises at least two different couplers from a class of microstrip couplers consisting of a Wilkinson coupler, a hybrid coupler, and a backward wave coupler.

5. A system according to claim 4 wherein said wavelength of said electromagnetic power is a free-space wavelength, and wherein each of said coupler assemblies comprises a transmission line structure interconnecting said couplers, said transmission line structure defines the moving conductor and includes the second output terminals of each of said couplers in any one of said coupler assemblies, and the couplers are spaced apart with a respective spacing therebetween of approximately the one wavelength of electromagnetic power propagating within the coupler assembly.

6. A system according to claim 4 wherein each of said coupler assemblies comprises a conductive ground plane and a plane of electrically conductive elements, the ground plane being spaced apart from said plane of electrically conductive elements, said main conductor being one of said electrically conductive elements.

7. An antenna comprising:

a plurality of radiators disposed along a surface for radiating electromagnetic power;

a plurality of elongated coupler assemblies disposed side by side in a common plane in a first direction, each of said assemblies extending in a second direction perpendicular to said first direction, each of said assemblies comprising a plurality of couplers of electromagnetic power arranged in a row extending in said second direction;

wherein, in any one of said assemblies, said plurality of couplers comprises three couplers, each of said couplers has an input terminal for receiving an input electromagnetic power, each of said couplers has a first output terminal for outputting a first fraction of said input power and a second output terminal for outputting a second fraction of said input power, said second fraction being a power division ratio of the coupler;

in any one of said assemblies, the division ratio of any one of said couplers has a nominal value which differs from a nominal value of the division ratio of a another of said couplers;

in each of said assemblies, each of said respective couplers has a respective phase-shift characteristic with introduction of a specific phase shift between said first output terminal and said second output terminal of the coupler, wherein a magnitude of the specific phase shift of any one of said couplers differs from a magnitude of the specific phase shift of another of said couplers;

in each of said assemblies, among said plurality of couplers in said assembly, the first output terminal of a first of said couplers is connected to the input terminal of a second of said couplers in the row of couplers, the first output terminal of said second coupler is connected to the input terminal of a third of said couplers in the row of couplers, and the second output terminals of said first coupler and of said second coupler and of said third coupler output electromagnetic power respectively to a first and to a second and to a third of said radiators;

each of said assemblies of couplers comprises a main conductor interconnecting the couplers of said row of couplers, the input terminal and the first output terminal of each of the couplers of said row of couplers comprising sections of said main conductor; and each of said coupler assemblies has a stripline form including a first conductive ground plane and a second conductive ground plane disposed on opposite sides of a central conductive plane and spaced apart from said central plane, said main conductor being disposed in said central plane, and said radiators being located at said first ground plane.

8. A system according to claim 7 wherein said plurality of elongated coupler assemblies are disposed side by side in said first direction with respective spacing therebetween being less than approximately one wavelength of said electromagnetic power, and in each of said assemblies, said couplers of electromagnetic power are arranged in said row with respective spacing therebetween being less than or approximately equal to a wavelength of said electromagnetic power;

said plurality of couplers in any one of said assemblies comprises at least two different couplers from a class of stripline-couplers consisting of a Wilkinson coupler, a hybrid coupler, and a backward wave coupler.

9. A system according to claim 7 wherein said plurality of elongated coupler assemblies are disposed by side in said first direction with respective spacing therebetween being less than approximately one wavelength of said electromagnetic power, and in each of said assemblies, said couplers of electromagnetic power are arranged in said row with respective spacing therebetween being less than or approximately equal to a wavelength of said electromagnetic power.

10. An antenna comprising:

a plurality of radiators disposed along a surface for radiating electromagnetic power;

a plurality of elongated coupler assemblies disposed side by side in a common plane in a first direction, each of said assemblies extending in a second direction perpendicular to said first direction, each of said assemblies comprising a plurality of couplers of electromagnetic power arranged in a row extending in said second direction;

wherein, in any one of said assemblies, said plurality of couplers comprises three couplers, each of said couplers has an input terminal for receiving an input electromagnetic power, each of said couplers has a first output terminal for outputting a first fraction of said input power and a second output terminal for outputting a second fraction of said input power, said second fraction being a power division ratio of the coupler;

in any one of said assemblies, the division ratio of any one of said couplers has a nominal value which differs from a nominal value of the division ratio of a another of said couplers;

in each of said assemblies, each of said respective couplers has a respective phase-shift characteristic with introduction of a specific phase shift between said first output terminal and said second output terminal of the coupler, wherein a magnitude of the specific phase shift of any one of said couplers differs from a magnitude of the specific phase shift of another of said couplers;

in each of said assemblies, among said plurality of couplers in said assembly, the first output terminal of a first of said couplers is connected to the input terminal of a second of said couplers in the row of couplers, the first output terminal of said second coupler is connected to the input terminal of a third of said couplers in the row of couplers, and the second output terminals of said first coupler and of said second coupler and of said third coupler output electromagnetic power respectively to a first and to a second and to a third of said radiators;

each of said assemblies of couplers comprises a main conductor interconnecting the couplers of said row of couplers, the input terminal and the first output terminal of each of the couplers of said row of couplers comprising sections of said main conductor;

each of said coupler assemblies has a microstrip form including a conductive group plane and a plane of electrically conductive elements, the ground plane being spaced apart from said plane of electrically conductive elements, said main conductor being one of said electrically conductive elements, and said radiators being located at said ground plane.

11. A system according to claim 10 wherein said plurality of elongated coupler assemblies are disposed side by side in said first direction with respective spacing therebetween being less than approximately one wavelength of said electromagnetic power, and in each of said assemblies, said couplers of electromagnetic power are arranged in said row with respective spacing therebetween being less than or approximately equal to a wavelength of said electromagnetic power.

12. A system according to claim 10 wherein said plurality of elongated coupler assemblies are disposed side by side in said first direction with respective spacing therebetween being less than approximately one wavelength of said electromagnetic power, and in each of said assemblies, said couplers of electromagnetic power are arranged in said row with respective spacing therebetween being less than or approximately equal to a wavelength of said electromagnetic power;

said plurality of couplers in any one of said assemblies comprises at least two different couplers from a class of microstrip couplers consisting of a Wilkinson coupler, a hybrid coupler, and a backward wave coupler.

* * * * *

UNITED STATES PATENT AND TRADEMARK OFFICE

CERTIFICATE OF CORRECTION

PATENT NO. : 5,349,364
DATED : September 20, 1994
INVENTOR(S) : Bryanos et al.

It is certified that error appears in the above-indentified patent and that said Letters Patent is hereby corrected as shown below:

In the claims:

In column 8, line 46 delete the word "next";
In column 8, line 49, "coupler" should be --couplers--;
In column 8, line 58, "interconnection" should be --interconnecting--
In column 8 and over to column 9, "these between" should be --therebetween-- ;
In column 9, line 11, "respect" should be --respective--;
In column 9, line 15, "respect" should be --respective--;
In column 9, line 28, "moving" should be --main--;
In column 10, line 42, after the word "disposed" insert --side--;
Column 9, line 28, before "second" should read --input terminal and the first and the--
Column 9, line 32, delete "the".

Signed and Sealed this

Thirteenth Day of December, 1994

Bruce Lehman

*Attest:*

BRUCE LEHMAN

*Attesting Officer*

*Commissioner of Patents and Trademarks*